US005334938A

United States Patent [19]

Kugler et al.

[11] Patent Number: 5,334,938

[45] Date of Patent: Aug. 2, 1994

[54] METHOD OF MONITORING AN INTERNAL COMBUSTION ENGINE IGNITION SYSTEM BY MEASURING SPARK DURATION OR VOLTAGE AND DISTINCTION BETWEEN ISOLATED ERRORS AND RECURRENT ERRORS

[75] Inventors: Karl-Heinz Kugler, Vaihingen; Arnd-Matthias Langner, Kornwestheim; Karlheinz Riedel, Vaihingen/Enz-Guendelbach; Richard Schleupen, Grossingersheim; Christian Zimmermann, Ingersheim, all of Fed. Rep. of Germany

[73] Assignee: Robert Bosch GmbH, Stuttgart, Fed. Rep. of Germany

[21] Appl. No.: 994,453

[22] Filed: Dec. 21, 1992

Related U.S. Application Data

[63] Continuation of Ser. No. 749,297, Aug. 23, 1991, abandoned.

[30] Foreign Application Priority Data

Aug. 25, 1990 [DE] Fed. Rep. of Germany ..... 4026919
May 22, 1991 [DE] Fed. Rep. of Germany ..... 4116642

[51] Int. Cl.[5] ..... F02P 17/00; F02P 11/02

[52] U.S. Cl. ..... 324/399; 324/379; 324/384; 73/117.2; 364/424.03

[58] Field of Search ..... 324/384, 388, 393, 395, 324/399, 378, 379; 364/424.03, 424.04; 73/116, 117.2

[56] References Cited

U.S. PATENT DOCUMENTS 4,291,383 9/1981 Tedeschi et al. ..... 324/384 X
4,918,389 4/1990 Schleupen et al. ..... 324/399

*Primary Examiner*—Gerard R. Strecker
*Assistant Examiner*—Diep Do
*Attorney, Agent, or Firm*—Frishauf, Holtz, Goodman & Woodward

[57] ABSTRACT

Monitoring apparatus is provided for the ignition system of an internal combustion engine such as is provided in a motor vehicle, which is capable of detecting a variety of malfunctions of ignition under a variety of engine operating ranges, so that the catalyst used in the exhaust system of the engine can be protected by setting lambda=0 and/or cutting off fuel injection to an inoperative cylinder, in as many instances of malfunction as possible. Various methods of monitoring are available and are correlated for selection in accordance with the different operating ranges of the engine. The ignition spark duration and the ignition discharge voltage are measured for individual sparks on the primary side of an ignition coil and are compared with limit values for correct ignition, these limit values being selected from a memory in accordance with the particular range of operating conditions in which the engine is operating. If the quality of malfunction detection is not good enough for individual ignition deficiencies to be reliably detected, deficiencies that are periodically recurrent or abnormally bunched are detected on a statistical basis.

13 Claims, 4 Drawing Sheets

METHOD OF MONITORING AN INTERNAL COMBUSTION ENGINE IGNITION SYSTEM BY MEASURING SPARK DURATION OR VOLTAGE AND DISTINCTION BETWEEN ISOLATED ERRORS AND RECURRENT ERRORS

This application is a continuation of application Ser. No. 07/749,297, filed Aug. 23, 1991.

FIELD OF THE INVENTION

This invention concerns an engine ignition system monitoring method and apparatus of the kind that monitors ignition events in the various cylinders of the engine through a connection to the primary winding of the ignition coil, measuring ignition spark duration and producing a malfunction signal when ignition fails.

BACKGROUND AND PRIOR ART

There is known from Schleupen et al U.S. Pat. No. 4,918,389, the disclosure of which is hereby incorporated by reference to which published European Patent Application 0 344 349 corresponds, a vehicular engine ignition system in which the monitoring is performed by monitoring the ignition spark duration through a connection to the primary side of an ignition coil. This kind of monitoring has the disadvantage that under certain operating conditions measuring the spark duration is not a reliable monitoring method. In particular where the high voltage is distributed by a rotary distributor, the sparks do not burn out at high engine speeds but are extinguished by the switching in again of the energizing circuit of the primary of the ignition coil.

Known monitoring procedures for ignition systems are, for example, the monitoring of catalyst temperature and the measurement of engine noise, of the lambda sonde signal and of the duration of the ignition spark.

These known methods do not provide results equally good in all ranges of operation of the engine, as has already been mentioned with reference to the measurement of the spark duration. External influences can also falsify the results, as for example in the case of engine noise measurement, which is impaired by road and power train irregularities (potholes and engine jerks).

SUMMARY OF THE INVENTION

It is an object of the present invention to provide a more comprehensive and reliable monitoring method and apparatus for an ignition system which avoids the shortcomings of previous vehicular engine monitoring apparatus.

Briefly, the monitoring method, in accordance with the invention, includes measuring apparatus, at the primary winding of one or more ignition coils, not only the ignition spark duration, but also the upwardly transformed ignition spark voltage of individual ignition events or attempts. Engine operating parameters are obtained from the engine during its operation and are used to determine in which of several kinds of operating ranges the engine is operating and then, according to the operating range and according to the measurement of spark duration or spark voltage or both of them, a boundary value is selected for comparison with a spark duration or a spark voltage measurement to provide a warning to the operator or a corrective action for the ignition system, or both.

The method of the invention has the advantage that various methods of malfunction recognition are correlated in the ignition system. Since the procedure of spark duration measurement and spark voltage monitoring used in the system of the invention provide malfunction protection possibilities of relatively different worth, it is advantageous to provide switching between these two procedures or to provide both at once in accordance to what is the operating point of the engine. The boundary values for correct ignition can be so determined that malfunction recognition will result with the greatest possible reliability with reference to the operating point of the motor, which can be calculated on the basis of measured operating parameters. In addition it is possible to switch between individual malfunction recognition and malfunction recognition on a statistical basis. Such switching depends upon the quality of malfunction detection or upon the operating point or the operating range at or in which the engine is operating.

It is particularly advantageous to change the malfunction detection thresholds or boundaries in accordance with the operating point of the engine. Besides, it is advantageous to correlate the methods of ignition failure recognition in such a way that from at least one procedure failures that occur even sporadically in certain ranges of operating conditions of the engine are detected in order to provide better protection of the catalyst used in the exhaust system.

A further advantage of the monitoring system lies in the possibility of arriving at conclusions regarding the load imposed on the internal combustion engine from measurements of the ignition spark duration and the ignition voltage. An increasing load, for example, produces a rising ignition voltage at the spark plug and a shorter spark duration. By means of the spark duration and ignition voltage values detected, the load on the engine may be determined by reference to a stored table.

DRAWINGS

The invention is further described by way of illustrative example with reference to the annexed drawings, in which.

Figure 4:
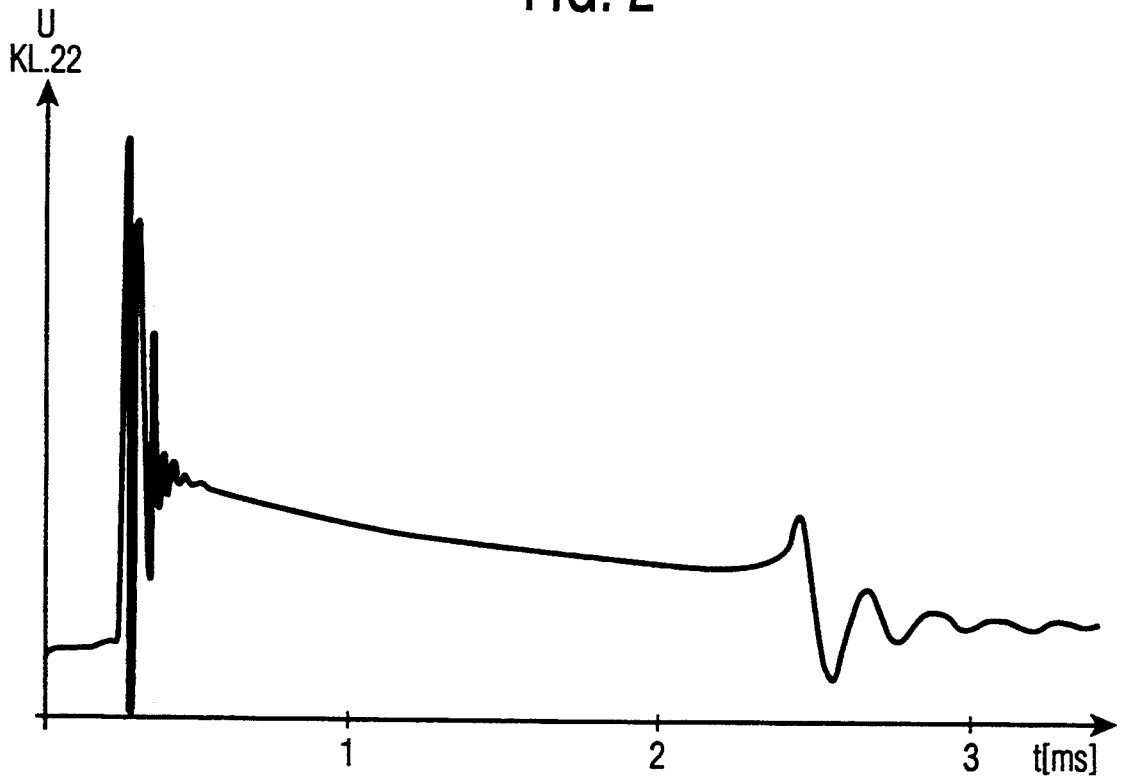
Figure 3A:
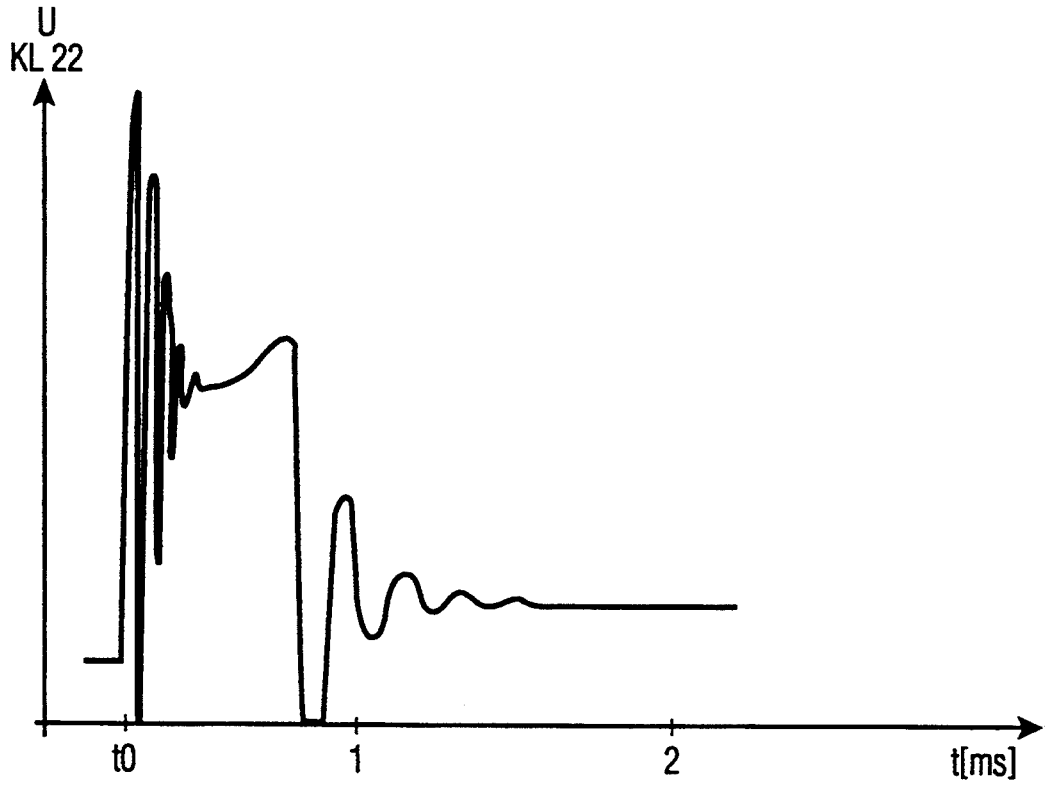
Figure 3B:
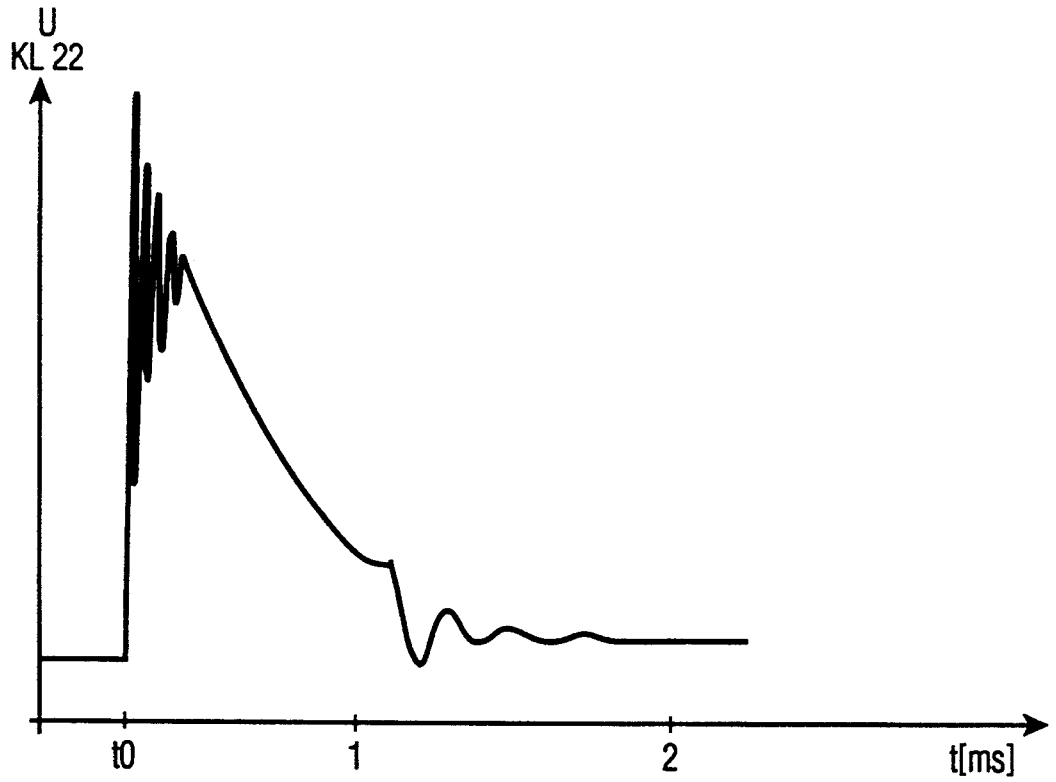
Figure 5:
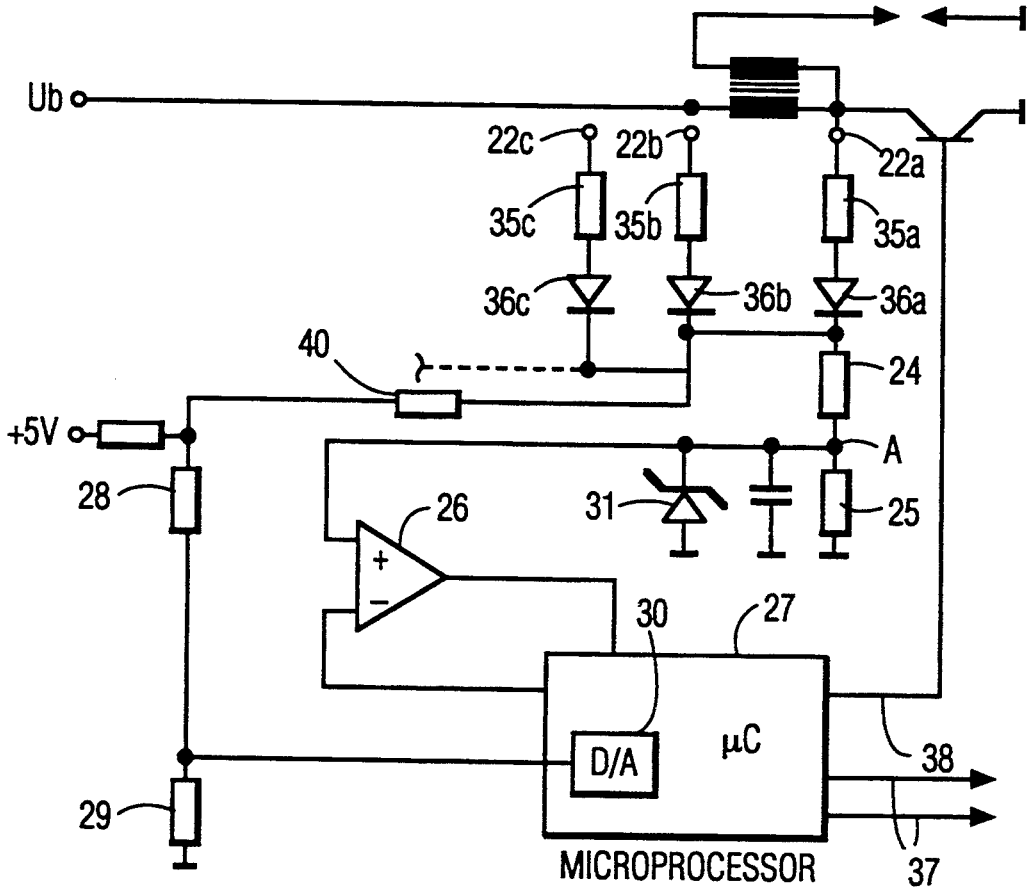

FIG. 3*a* is a graph of the course of voltage at the primary side of an ignition coil in the case of a failure produced by the falling off of a spark plug connector;

FIG. 3*b* is a graph showing the course of voltage on the primary side of an ignition coil in the case of a failure resulting from a leakage shunt at the spark plug;

FIG. 4 is a graph of the voltage course at the primary side of an ignition coil in the case of normal ignition, for comparison, and FIG. 5 is a diagram of a spark duration measurement circuit for an ignition system with noiseless high-voltage distribution.

DESCRIPTION OF THE ILLUSTRATED EMBODIMENTS

Figure 1:
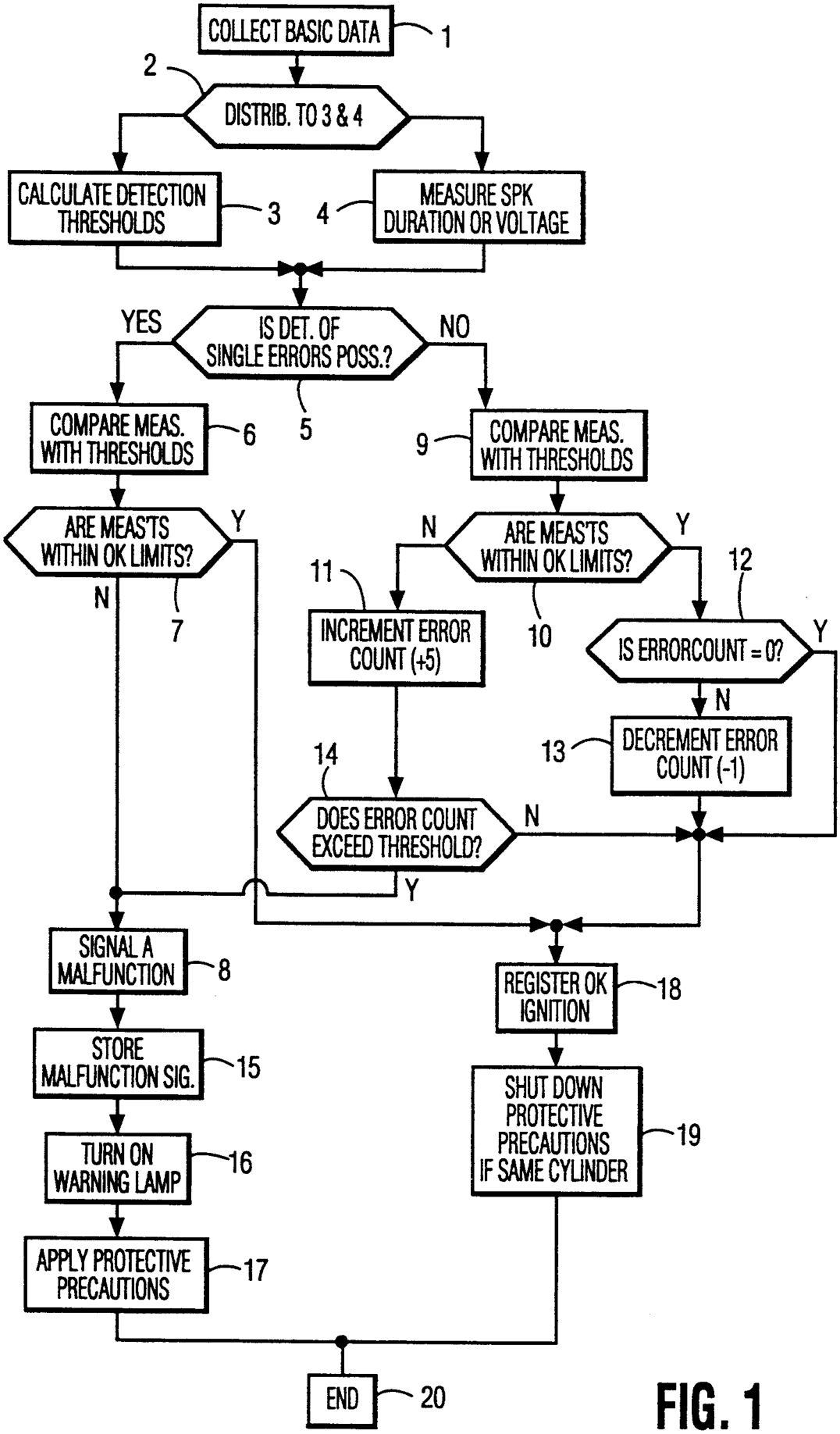
FIG. 1 is a flow diagram of a process of malfunction recognition utilized in the monitoring system of the invention.
Figure 2:
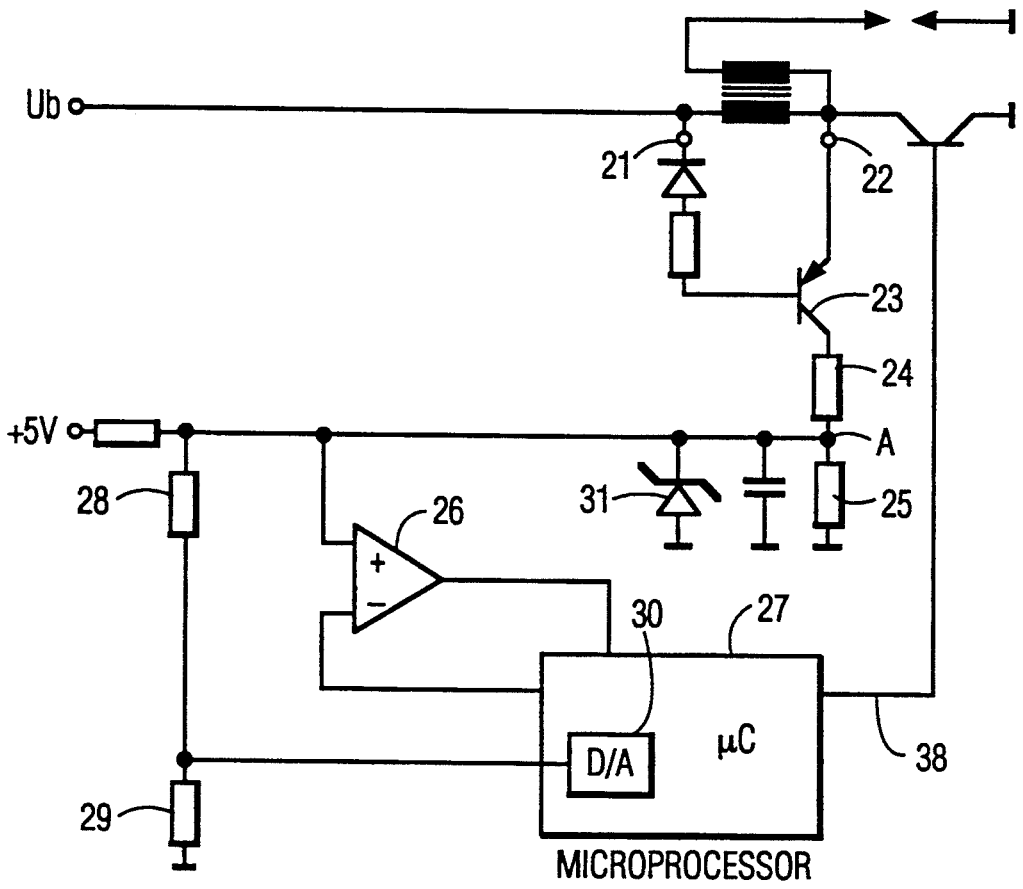
FIG. 2 is a circuit diagram of a spark duration measurement circuit.

The circuit shown in FIG. 2 provides spark duration monitoring of varying quality of malfunction detection capability in different operating ranges of the internal combustion engine and for this reason the operation or flow diagram given in FIG. 1 shows an ignition spark monitoring method which correlates two individual procedures of ignition spark monitoring, which are both provided in the circuit of FIG. 2.

The program flow diagram shown in FIG. 1 has the following manner of operation.

In program step 1 the concrete or basic engine operation parameters (such, for example, as engine speed, in r.p.m., engine load, engine temperature, etc.) are determined and in program step 2 they are collected for the purpose of a later selection of one of the two above-mentioned monitoring procedures, the determination of spark duration being well suited for an operating range of low engine speeds and the spark voltage determination being well suited for the range of higher engine speeds. Thus, for example, it is undesirable, when the high voltage distribution is performed by a rotary distributor, to measure the spark duration at engine speeds above 4000 r.p.m. The measurement of the spark duration is in general unreliable when residual energy remains in the spark coil, i.e. when the ignition spark is prematurely extinguished. On the other hand, the ignition voltage provides no reliable method of detecting ignition failure when the engine is operating in the full load range of operation. In this last case, both the method of spark duration measurement and malfunction detection by statistical means are performed. It can also happen that both procedures (spark duration monitoring and spark voltage monitoring) provide equally good, usable results. In this case both procedures are allowed to run with equal participation, thus providing a supplementary possibility of control which is not shown in FIG. 1.

The spark voltage can be measured by the circuit in FIG. 2 which is described further below, this procedure being known principally from Schleupen et al U.S. Pat. No. 4,918,389. In program step 3 the calculation of the malfunction detection thresholds takes place, these thresholds for malfunction detection being always calculated for the basic engine operating point, for example by means of a field of characteristic values dependent upon engine load and engine speed.

In program step 4 the measurement of the spark duration takes place. For that purpose it is possible to use already known circuits and procedures, as for example the ignition spark duration measurement known from Schleupen et al U.S. Pat. No. 4,918,389.

The results from program steps 3 and 4 are collectively supplied for the interrogation step 5 and it is determined according to the malfunction recognition quality whether it is possible to detect individual malfunctions or whether statistical methods should be used. For example when the engine load is small, especially when the engine operates in a vehicle at on load or negative load, the detection reliability is good for individual malfunction detection, but in operation under load the situation is more critical. The decision of choosing between individual malfunction detection and malfunction detection by statistical methods is performed on the basis of the available detection quality. Thus, for example, the measured parameters (spark duration, spark voltage) both for normal ignition and also for cases of malfunction as a rule show normal distribution, while the distribution groups can persist even while the average and the scatter of measurements differ. In consequence the average value and scatter of the measurement can be obtained with statistical methods and applied to detection of malfunction.

If the interrogation of step 5, whether it is possible to detect individual events of malfunction, can be answered with "yes" then in step 6 the measured values are compared in a comparator with the malfunction detection thresholds calculated in program step 3. In step 7 it is checked whether the measured values (ignition voltage and/or spark duration) lie within limit values, dependent upon the engine operating point, which are suitable for correct ignition. If this is the case, the observed ignition is normal, and is registered as such in program step 18. If the interrogation step 5 produces a negative answer, a malfunction detection (or "error") is registered in program step 8. This error occurrence is registered in a memory in program step 15. In addition, a warning lamp is energized in program step 16. In program step 17 the corresponding measures for protection of the catalyst are initiated. Thus it is conceivable that shutting off of fuel injection for the corresponding cylinder might be carried out, in which case there may be either an individual shutting off in sequential injection or else a group shut-off. The normal lambda control is also switched off and in the corresponding control unit the control is set to lambda=1.

If it should be decided in the interrogation of step 5 that no individual detection of malfunction events can take place because of the low quality of their recognition, and only those errors can be recognized which appear with a certain bunching or appear periodically at particular time intervals, there will then be carried out in step 9 a comparison of the measured values with the corresponding malfunction detection thresholds, using a comparator. If the measurements lie within the permissible thresholds, it is checked in a question unit 12 whether the error count FZ=0. If that is not the case, then in program step 13 the error count is set back by subtraction (FZ−A) of a constant magnitude. For example, A=1 might be used. In program step 18 a normal ignition is then registered. The normal ignition thus registered is supplied to program step in exactly the same way as a registered normal ignition reported from the interrogation step 7. This has the effect in program step 19 that ultimately the already initiated malfunction precautions are shut down. If in the interrogation step 10 it is found that the measured values do not lie within the permissible thresholds, the error count is raised with an additive magnitude by addition in program step 11 (FZ+B, where B for example may be 5).

In an interrogation step 14 it is checked whether the error count exceeds a predetermined threshold, this threshold being predetermined at a value specific for the particular application. In the present case it may for example be 80 Hx which signifies 128 in ordinary numbers. If the error count lies below this threshold, an ignition O.K. decision is registered as described in program step 18.

In the case of an error count exceeding the predetermined threshold, a malfunction is recognized in program step 8 and this leads to the above-described precautions. It is necessary to mention that the calculation of the malfunction detection thresholds mentioned in program step 3 must take into account that spark duration and ignition voltage vary strongly over the operating range of the engine even when ignition is normal and, moreover, there can be differences in these measurements between individual cylinders. Thus for example in an engine in a vehicle operating at no load the ignition spark duration is very long, whereas when the engine is operating under load the spark duration is considerably shorter. It is therefore advantageous to adapt the malfunction recognition thresholds to the different engine operation conditions, since in that way the reliability of recognition is raised. Such adaptation can be implemented, for example, by means of a field of characteristic values for the thresholds calculated for the respective different ranges of engine operating points and these calculations may also provide different values for the respective cylinders. A further advantageous extension of this concept is to change adaptively the recognition thresholds which are calculated or taken from a read-only memory to take account of parameters that change with the cylinder firing order or the like and have an effect on the ignition discharge voltage and spark duration in normal ignition. The amount of compression, for example, may vary among the cylinders and may have such an effect.

For example average values and scatter can be observed as the engine runs with normal ignition for correcting the malfunction detection thresholds that are calculated or are deposited in a read-only memory. Correction magnitudes can advantageously be stored in a long-term memory (EEPROM or non-volatile ROM) and further changes, resulting perhaps from depositing of carbon on the spark plugs, may then be entered by overwriting the new correction values in the memory.

FIG. 2 shows one possibility for monitoring the voltage at the primary winding of the ignition coil. This circuit resembles U.S. Pat. No. 4,918,389. For this reason it will not be explained in the entirety of its operation, but it should nevertheless be explained here that the primary winding of the ignition coil is connected between the terminals 21 and 22 of FIG. 2 and that the battery voltage $U_b$ is applied to the terminal 21. The voltage induced in the primary winding is supplied through a transistor 23 and through a voltage divider connected to it, to the non-inverting input of a comparator 26. The second input of the comparator has applied to it a predetermined switching threshold supplied from a microprocessor 27, the threshold being selected in the microprocessor to suit the operating point of the engine. A binary logic signal corresponding to the ignition spark duration is made available at the output of the comparator 26 and is supplied to an input port of the microprocessor.

The amplitude of the signal applied to the point A corresponds to the spark discharge voltage.

In the above-cited U.S. patent reference, the circuit of FIG. 2 serves exclusively for measuring an evaluation of the ignition spark duration. The voltage at the terminal 22 of the ignition coil, and thereby the ignition discharge voltage, can be measured, however, as a supplementary detection criterion in FIG. 2. For that purpose the heretofore known circuit can be extended in such a way that the signal at the point A is then limited to a voltage value that will not damage the circuit, by means of the Zener diode 31, after which the signal so limited goes to a voltage divider 28, 29, from the tap of which it is supplied to an analog-to-digital converter 30 located in the microprocessor 27.

Still other evaluation logic possibilities also come into consideration. The procedure of measuring the ignition discharge voltage can be utilized both instead of the spark duration measurement and also in combination with the latter.

In the procedure for monitoring the primary voltage of the ignition coil, it is advantageous to sample the primary voltage at least at one fixed instant for each expected ignition event. This instant can advantageously be set at 250 to 400 microseconds after the interruption of direct current in the ignition coil primary winding, although a better quality of malfunction recognition can be obtained by multiple sampling. Thus, for example, 4 to 5 samples in one 100 microsecond pattern could advantageously be used.

FIGS. 3*a* and 3*b* show the time courses of voltage at the primary winding for two typical malfunctions, FIG. 3*a* for the case of a spark plug connector that has fallen off and FIG. 3*b* for the case of a shunt across the spark plug.

FIG. 4 shows the time course of voltage at the primary winding of the ignition coil during a normal ignition, for purposes of comparison with FIGS. 3*a* and 3*b*.

In all of FIGS. 3*a*, 3*b* and 4, the time course of voltage at the terminal 22 is shown.

In FIG. 4 it can plainly be seen that the ignition spark, after initial oscillations, burns out in a time span of, for example, 3 ms and the primary voltage declines until, after that time span, the ignition spark breaks off. At the end of the spark a short oscillation appears in the opened circuit.

In contrast to FIG. 4, a high voltage is built up in the case of FIG. 3*a*, but because of an interruption of the circuit on the secondary side, it cannot be supplied to the spark plug, which means that no typical discharge behavior as in FIG. 4 is to be seen, in which the high voltage declines slowly.

FIG. 3*b* shows, again, the induction of a high voltage in the ignition coil, which however, leads to no ignition spark because the high voltage quickly dissipates over shunt circuit paths of a spark plug where carbon has been deposited.

FIG. 5 shows one way of monitoring, according to the invention, the voltage at the primary winding of an ignition coil in an ignition system having a noiseless distribution of high voltage to the spark plugs of the respective cylinders. For this purpose the circuit of FIG. 2 has been correspondingly extended in FIG. 5. The same components are given the same reference numerals. The overall manner of operation of this circuit is not explained here because it corresponds so closely to FIG. 2. In this case the evaluation circuit is coupled through the terminal 22 into the primary circuit of the ignition coil, and the indices a, b, c are intended to show that the signals are taken off from corresponding terminals of several ignition coils respectively serving the several cylinders in their firing order, while for their evaluation these signals are supplied to the common point A respectively through resistors 35*a*, 35*b* and 35*c* . . . . The common point to which the diodes 36*a*, 36*b*, 36*c* . . . are connected then furnishes the several signals to the voltage divider 24, 25, from the point A of which the signals representative of the ignition voltage are limited by the Zener diode 31 to a safe value and supplied to the comparator 26 for evaluation in the microprocessor 27. A 5 volt source sets the quiescent state of the circuit. In this case, instead of furnishing the voltage at point A to the voltage divider 28, 29 as in FIG. 2, the voltage from the top of the voltage divider 24, 25 is supplied to the divider 28, 29 through an additional resistance 40. The outputs 37 from the microprocessor 27 represent connections like the connection 38 for turning on the d.c. current from the battery connection Ub and interrupting it with the proper timing for the ignition in the respective cylinders served by the respective ignition coils. In the circuit of FIG. 5 only one evaluation circuit is needed to serve several ignition coils provided for the respective cylinders.

Although the invention has been described with reference to particular illustrative examples, it will be recognized that variations and modifications are possible within the inventive concept.

We claim:

1. A method of monitoring an ignition system of an internal combustion engine comprising the steps of:

continually, contemporarily measuring engine operating parameters including engine speed and engine load, and deriving from combinations of said contemporarily measured parameters an indication of one condition of engine operation, within a range of several ranges of engine operation conditions;

measuring, for a sequence of successive ignition sparks, in at least one cylinder the spark voltage, by sensing said spark voltage induced in a primary winding of an ignition coil;

comparing, for an ignition spark of said sequence, the measured spark voltage with a previously stored limit value of spark duration and with a previously stored limit value of spark voltage and in each case thereby providing a designation of adequacy or deficiency, of the measured spark voltage of said successive sparks in terms of spark voltage induced in said primary winding of said ignition coil;

determining from at least one designation of deficiency among said designations of adequacy or deficiency whether a signal malfunction recognition or a statistical recognition of malfunction from said sequence of ignition events is preferable, based on the condition of engine operation within the range;

in the event of preference of a statistical recognition of malfunction, performing the following steps:

in response to every ignition spark of said sequence for which a said deficiency is designated, incrementing a malfunction counter (FZ), by a predetermining first count value (B);

in response to every ignition spark of said sequence for which no said deficiency is designated, decrementing said malfunction counter by a predetermined second count value, said second count value (A) being smaller than said first count value; and as soon as the count value of said malfunction counter exceeds a predetermined third count value which is at least twice as great as said first count value, producing at least a malfunction signal for the attention of a person using said internal combustion engine.

2. The method of claim 1 including storing a plurality of limit values of spark duration and of spark voltage, respectively;

selecting, in accordance with said respective indication of engine operation within a range, at least one of said previously stored limit values of spark duration and at least one of said previously stored limit values of spark voltage; and wherein the so selected stored limit values are used in the step of comparing a measured spark voltage and a measured spark duration respectively with said stored limit values.

3. The method of claim 2, wherein said pluralities of limit values each include limit values which are not the same for all cylinders and are correlated for selection according to a cylinder in which an ignition event occurs.

4. A method of monitoring an ignition system of an internal combustion engine comprising the steps of:

continually, contemporarily measuring engine operating parameters including engine speed and engine load, and deriving from combinations of said contemporarily measured parameters an indication of one condition of engine operation, within a range of several ranges of engine operation conditions;

measuring, for a sequence of successive ignition sparks in at least one cylinder, the spark voltage, by sensing said spark voltage induced in a primary winding of an ignition coil;

comparing, for an ignition spark of said sequence, spark duration represented by measured spark voltage with a previously stored limit value of spark duration thereby providing a designation of adequacy or deficiency, of the measured spark duration of said successive sparks in terms of spark voltage induced in said primary winding of said ignition coil;

determining from at least one designation of deficiency among said designations of adequacy or deficiency whether a single malfunction recognition or a statistical recognition of malfunction from said sequence of ignition events is preferable, based on the condition of engine operation within the range;

in the event of preference of a statistical recognition of malfunction, performing the following steps;

in response to every ignition spark of said sequence for which a said deficiency is designated, incrementing a malfunction counter (FZ), by a predetermining first count value (B);

in response to every ignition spark of said sequence for which no said deficiency is designated, decrementing said malfunction counter by a predetermined second count value, (A) said second count value being smaller than said first count value; and as soon as the count value of said malfunction counter exceeds a predetermined third count value which is at least twice as great as said first count value, producing at least a malfunction signal for the attention of a person using said internal combustion engine.

5. The method of claim 4 including storing a plurality of limit values of spark duration;

selecting, in accordance with said respective indiction of engine operation within a range, said previously stored limit values of spark duration are stored; and wherein the so selected stored limited values are used in the step of comparing a measured spark duration with a said stored limit value.

6. The method of claim 5, wherein said plurality of limit values includes limit values which are not the same for all cylinders and are correlated for selection according to a cylinder in which an ignition event occurs.

7. The method of claim 4 including storing a plurality of limit values of spark voltage;

selecting, in accordance with said respective indication of engine operation within a range, at least one of said previously stored limit values of spark voltage are; and wherein the so selected stored limited values so selected are used in the step of comparing a measured spark voltage with a said stored limit value.

8. The method of claim 7, wherein said plurality of limit values includes limit values which are not the same for all cylinders and are correlated for selection according to a cylinder in which an ignition event occurs.

9. The method of claim 2, 5 or 7, wherein, in the event of preference of recognition of individual malfunctions rather than a statistical recognition of malfunction, a said designation of deficiency is used to produce at least a malfunction signal for the attention of a person using said internal combustion engine.

10. The method of claims 3, 6 or 8, in which, in the event of preference of a statistical recognition of malfunction, a malfunction counter is provided for each cylinder and in which cylinder designations are reported for each ignition event and the steps of incrementing and decrementing, each of said malfunction counters are performed only in response to ignition events relating to the cylinder for which the respective counter is provided.

11. The method of claim 10, wherein the step of producing at least a malfunction signal when a malfunction counter exceeds said third predetermined count value produces at least a malfunction signal affecting only the cylinder to which the said malfunction counter relates.

12. A method of monitoring an ignition system of an internal combustion engine comprising the steps of:

continually, contemporarily measuring engine operating parameters including engine speed and engine load, and deriving from combination of said contemporarily measured parameters an indication of one condition of engine operation of several engine conditions within a plurality of operating condition ranges, wherein said ranges have limit values of said parameters;

measuring, for a sequence of successive ignition sparks, in at least one cylinder the spark voltage, by sensing said spark voltage induced in a primary winding of an ignition coil, said limit values being in terms of spark voltage induced in said primary winding of said ignition coil;

comparing, for an ignition spark of said sequence, the measured spark voltage with a previously stored limit value of spark voltage and in each case providing a designation of adequacy or deficiency;

determining from at least one designation of deficiency among said designations of adequacy or deficiency whether a single malfunction recognition or a statistical recognition of malfunction from said sequence of ignition sparks is preferable, based on the condition of engine operation within one of said ranges;

in the event of preference of a statistical recognition of malfunction, performing the following steps:

in response to every ignition spark of said sequence for which a said deficiency is designated, incrementing a malfunction counter (FZ), by a predetermining first count value (B);

in response to every ignition spark of said sequence for which no said deficiency is designated, decrementing said malfunction counter by a predetermined second count value (A), said second count value being smaller than said first count value; and as soon as the count value of said malfunction counter exceeds a predetermined third count value which is at least twice as great as said first count value, producing at least a malfunction signal for the attention of a person using said internal combustion engine.

13. The method of claim 1, 4 or 12, wherein, in the event of preference of recognition of individual malfunctions rather than a statistical recognition of malfunction, a said designation of deficiency is used to produce at least a malfunction signal for the attention of a person using said internal combustion engine.

* * * * *